United States Patent [19]

Pastva

[11] Patent Number: 4,918,866

[45] Date of Patent: Apr. 24, 1990

[54] DOOR CONTROL MECHANISM

[75] Inventor: John V. Pastva, Parma Heights, Ohio

[73] Assignee: The Eastern Company, Cleveland, Ohio

[21] Appl. No.: 89,431

[22] Filed: Aug. 26, 1987

[51] Int. Cl.[5] ..... E06B 3/34

[52] U.S. Cl. ..... 49/381; 292/300; 296/50

[58] Field of Search ..... 292/300, 342, DIG. 39, 292/DIG. 40, DIG. 73; 49/366, 367, 368, 369, 381, 400, 401, 402; 296/50, 146; 105/280, 410; 109/74

[56] References Cited

U.S. PATENT DOCUMENTS

| | | | |
|---|---|---|---|
| 1,771,184 | 7/1930 | McLanghlin | 292/D39 |
| 3,099,473 | 7/1963 | Pastva | 49/366 |
| 3,134,618 | 5/1964 | Heimann | 292/240 |
| 3,784,243 | 1/1974 | Pastva, Jr. | 49/366 |
| 4,146,257 | 3/1979 | Pastva | 292/218 |
| 4,235,463 | 11/1980 | Benevenuta | 292/218 |
| 4,601,501 | 7/1986 | Pastva | 49/366 |

FOREIGN PATENT DOCUMENTS

| | | | |
|---|---|---|---|
| 470542 | 1/1951 | Canada . | |
| 713292 | 7/1965 | Canada . | |
| 1308927 | 8/1971 | United Kingdom | 296/50 |
| 1363944 | 8/1974 | United Kingdom | 296/50 |

*Primary Examiner*—James R. Brittain
*Assistant Examiner*—Gerald Anderson
*Attorney, Agent, or Firm*—Watts, Hoffman, Fisher & Heinke Co.

[57] ABSTRACT

In a truck, trailer and/or cargo carrying container having a rectangular door frame and a door pivoted at one edge to an upright side of the frame which are subject to racking during use, a follower and cam member secured to the door and frame, respectively. The follower and cam are generally located midway between the pivoted edge of an opposite edge of the door, whereby the follower engages the cam member during and after closing of the door.

9 Claims, 4 Drawing Sheets

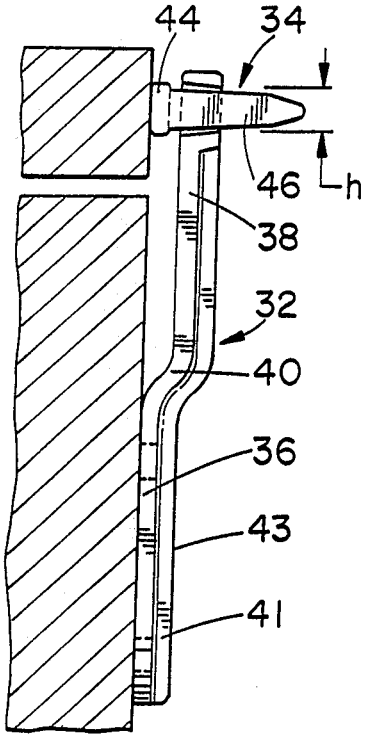
FIG. 4
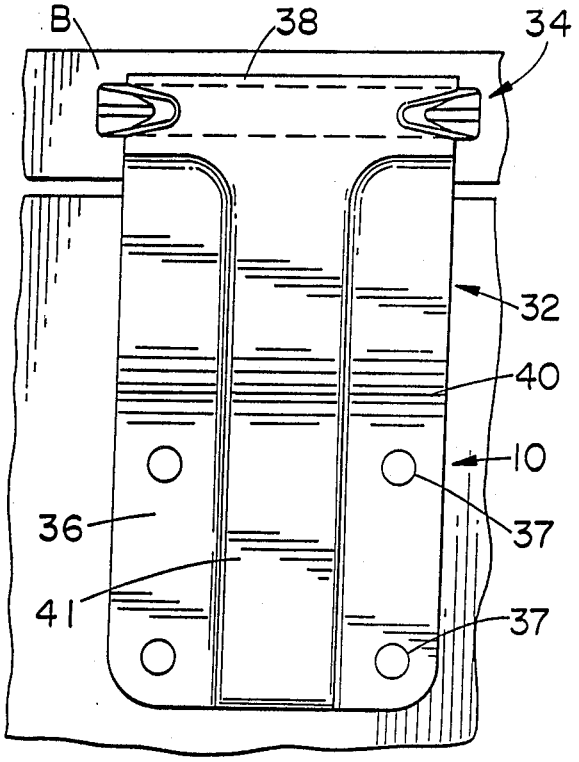
FIG. 3
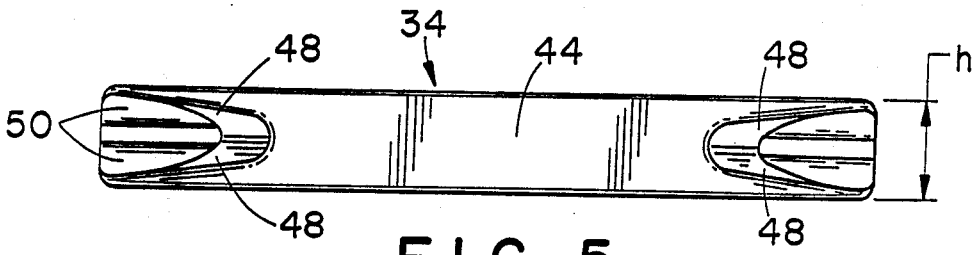
FIG. 5
FIG. 6
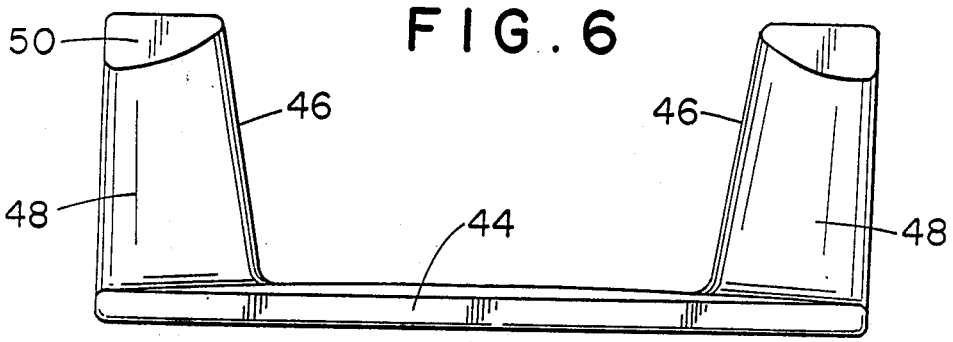

DOOR CONTROL MECHANISM

DESCRIPTION

1. Technical Field

The present invention relates to door control mechanisms used to align and maintain alignment of the pivoted doors of cargo carrying structures in their associated door frames, which are subject to racking during use.

2. Background Art

Cargo carrying containers such as truck trailers typically utilize hinged pivoted doors at one end of the container for loading and unloading items carried in the container compartment. Various door control mechanisms are used in connection with such doors to maintain and align the doors, and their associated door frames, against the shifting and distortion which occurs between these components as a result of load forces applied to the compartments. One type of mechanism which is normally used to maintain the doors in a closed position includes rotatable shafts or lock rods which extend the full height of the doors. Latching cams are mounted on opposite ends of the shafts, and keeper members mounted on the door frame are positioned for cooperating engagement with the latching cams.

In the past latching mechanisms of this type have also included complementary elements to resist the "racking" effect on the doors and frame once the doors are closed, and thereby reduce the amount of stress to the latching mechanisms. One mechanism which includes such elements is illustrated in U.S. Pat. No. 3,784,243. The door restraining device includes two interengageable members fixed opposite one another each on an inner verticle edge of one hinged pivoted door.

Once in the closed position, the components act automatically to produce a rigidifying effect inhibiting racking movement between the double doors and/or the door and frame.

DISCLOSURE OF INVENTION

In accordance with the present invention, a door control mechanism to align and maintain a pivoted door is provided which forcibly and progressively aligns the door within its associated door frame when the door is partially open and moved to the closed position. Once the door is in the closed position the mechanism maintains alignment of the door and frame.

In a preferred embodiment the mechanism is mounted on a cargo carrying structure having a rectangular door frame with a door pivotally hinged to an upright side of the frame. The mechanism includes follower and cam members; with the follower member being mounted on the door, midway between the pivoted edge and an opposite edge. A cam member is mounted on the associated door frame to engage and cooperate with the follower during and after closing of door. The cam member has a small height and is therefore capable of use with narrow headers (the upper frame portion of cargo containers), which have become increasingly narrow in order to maximize the height of the door openings which access the container interior. Although the cam member is small in height, the strength of the member to resist racking has not been compromised. The mechanism of this invention is inexpensive to manufacture and use, as it requires no moving parts, no assembly other than mounting, and utilizes identical follower and cam member parts mounted on upper and lower portions of both the left and right door and their associated door frames.

According to the invention, both the follower and cam members include mounting portions adapted for securing the members to the face of the pivoted door and associated door frame, respectively. The follower member includes follower surfaces overlapping the edge of the door for engagement with the cam member during movement of the door from the partially open to the closed position. The follower surfaces engage wedge portions extending from the cam member out of the plane of the door and frame that catch the follower and force the door into alignment while the door is still partially open. The wedge portions include surfaces to receive and cooperate with the opposed follower surfaces as the door is pivoted into alignment and maintained the closed position.

These and other features and advantages of the invention will be better understood from the following description of the invention shown in the accompanying drawings.

DESCRIPTION OF DRAWINGS

FIG. 3 is an elevational view of a part of FIG. 1 illustrating the mechanism of the present invention with the doors in the closed position;

FIG. 4 is a side view of the mechanism of FIG. 3;

FIG. 5 is an enlarged front view of the cam member of the mechanism of FIG. 3;

FIG. 6 is an enlarged top view of the cam member shown in FIG. 5;

BEST MODE FOR CARRYING OUT THE INVENTION

Figure 1:
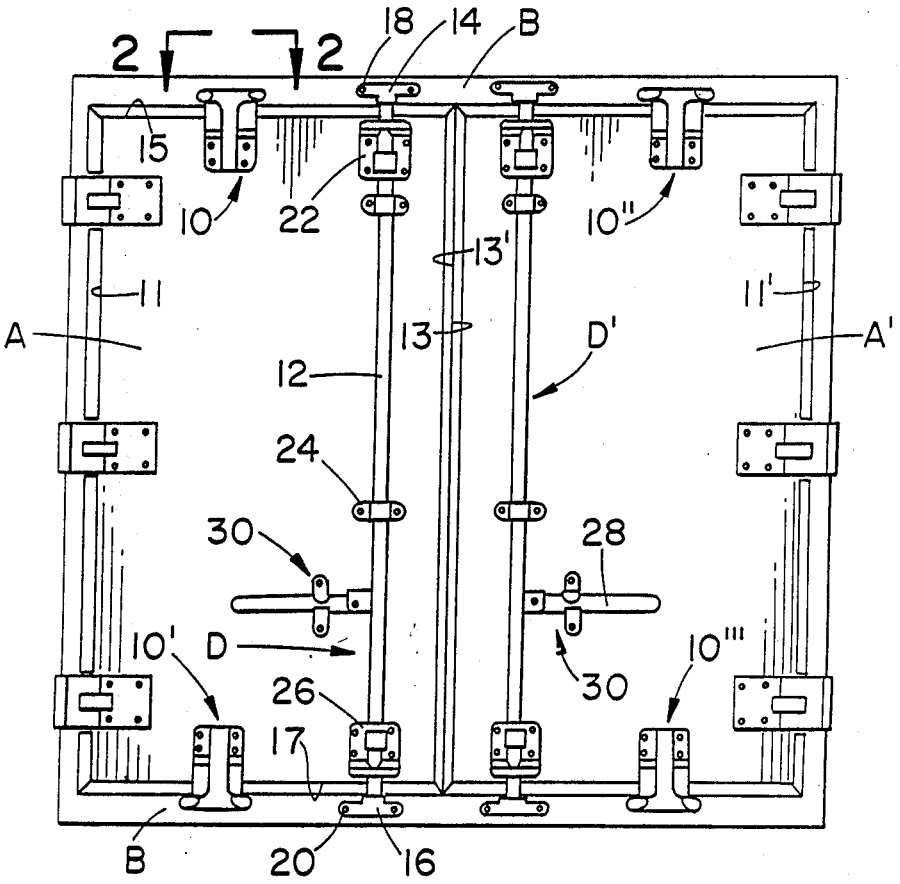
FIG. 1 is a partial front elevational view of the back end of a truck, trailer or cargo carrying container having double access flush-type doors equipped with the mechanism of the present invention.

The door control mechanism of the present invention for aligning and maintaining flush-type pivoted doors against racking is shown as applied to a cargo carrying structure of the FIG. 1 description, but is equally applicable to other door configurations. As illustrated, parts of the door control mechanisms 10, 10', 10'', 10''' are secured to the pivoted rear doors A, A' and associated door frame B, of the cargo carrying structure C. The doors A, A' are hinged to the door frame B along their outer vertical edges 11, 11'. Door closure mechanisms D and D' latch the doors in a closed position once they are engaged with the frame B, and provide additional resistance against racking experienced by the doors and frame.

Door closure or latching mechanisms D, D' of the type illustrated are commonly used, and are described in further detail in U.S. Pat. No. 3,737,183. Such devices preferably include a pivotal shaft or lock rod 12, 12' extending parallel to and near a vertical edge 13, 13' of the doors A, A'. As the door latching mechanisms D, D' are identically arranged and mounted, only one such configuration will be described in detail. Upper and lower cam latch members 14, 16 are attached to opposite ends of the shaft 12 and extend above an upper edge 15 and below a lower edge 17 of the door. Upper and lower keeper members 18, 20 are secured to the door frame B for cooperating with upper and lower cam latch members to align and maintain the door A in a closed position with the door frame B. Upper, intermediate and lower brackets 22, 24, 26 secure the shaft to the door adjacent the non-hinged vertical edge 13 of the door for rotation about the longitudinal axis of the shaft. A handle 28 is attached to the shaft 12 for rotating the shaft about its longitudinal axis, and a handle retaining structure, generally referred to by reference numeral 30, maintains the handle 28 in a fixed position when the door is closed.

The upper and lower latch members 14, 16, are operated by rotation of the shaft 12, to engage and cooperate with associated upper and lower keeper members 18, 20, which are secured to the frame B above and below upper and lower edge portions 15, 17 of the door A, to insure proper alignment and maintenance of the door A in the closed position.

Figure 2:
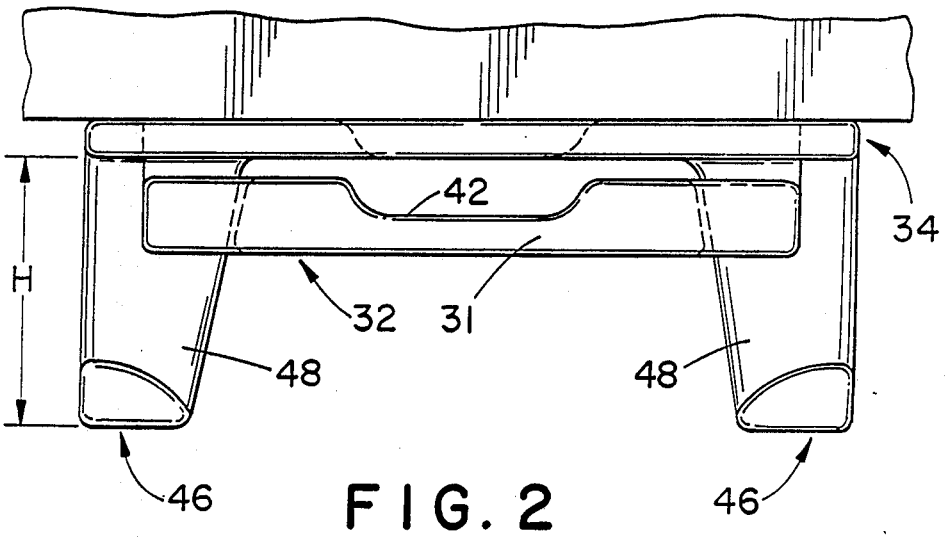
FIG. 2 is an enlarged top view of the door control mechanism of the present invention taken along the line 2—2 of FIG. 1.

The door control mechanism 10 of the present invention, as illustrated in FIGS. 2, 3 and 4, is comprised of two parts or members, each carried either on a door A, A' or an associated portion of the door frame B, such that they are inter-engageable when the doors are partially to fully closed. While not described in detail, duplicate mechanisms 10',10'', 10'' are provided at upper and lower edges of the doors A, A'. The door control mechanisms 10'', 10'' and the door closure mechanism D' mounted on the door A' are duplicate assemblies of the mechanisms 10, 10' and D mounted on door A.

A cooperable interrelationship between the two parts 32, 34 of the door control mechanism 10 allows alignment of door A within frame B to begin before the door is completely closed. The mechanism 10 includes a follower member 32 secured to an outer surface of the door A close to the upper edge 15 of door A, and a cam member 34 secured to an outer surface of the frame B in a position for engagement with the follower 32 during and after closing of the door A.

The follower member 32 has a rectangular plate-like configuration. The member includes a mounting portion 36 with apertures 37 to facilitate attachment to the outer surface of door A. The follower member 32 further includes an engagement portion 38 which extends along the top edge 33 of the member in overlapping relationship with the frame B when the door travels to the closed position and engages the cam member 34. As shown, the top edge 31 of the follower 32 on the engagement portion 38 extends transversely to the rotational axis of the door A.

Figure 7:
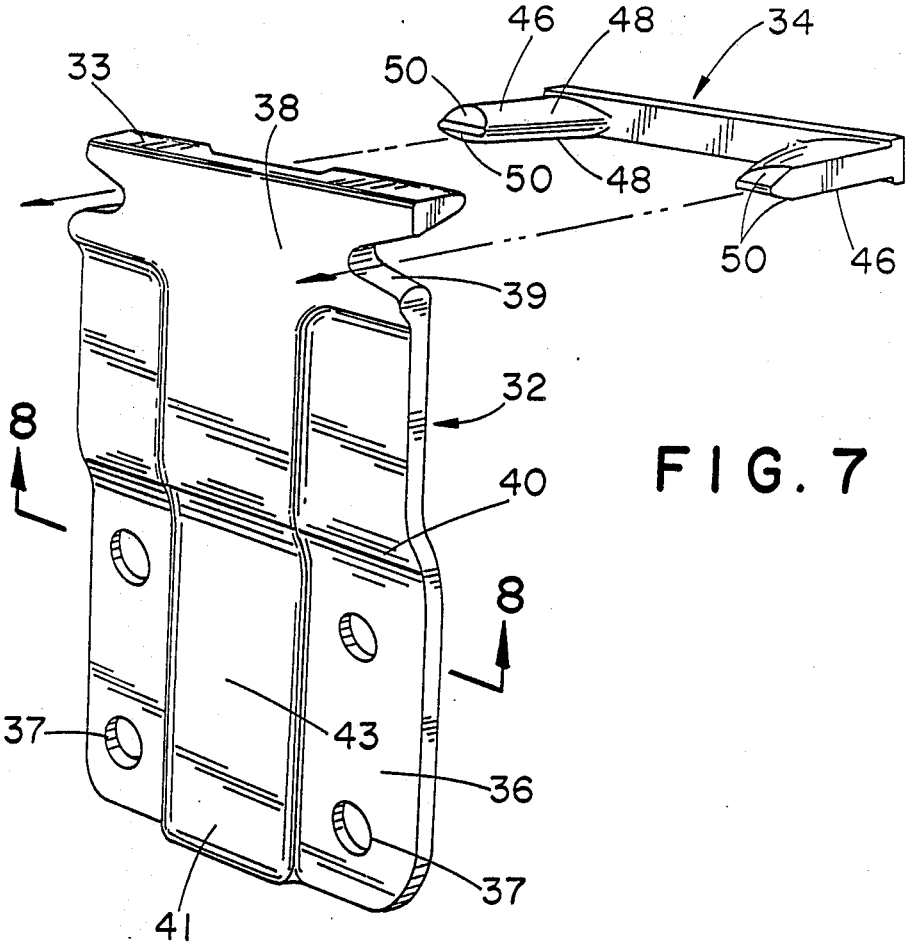
FIG. 7 is a perspective view of the mechanism of the present invention illustrating the cam member and the follower member.

In FIGS. 4 and 7, the engagement portion 38 is shown as being spaced from and parallel with the overlapped surface of the door frame B. The engagement portion 38 is interconnected with the mounting portion 36 by a bridge or transition portion 40.

Follower surfaces 39 are provided on the engagement portion 38 overlapping the door frame B. The follower surfaces 39 are transverse to the pivotal axis of the door A and shaft 12. In the illustrated embodiment, two pairs of opposed follower surfaces 39 are provided in the engagement portion 38, with each pair of surfaces being transverse to the shaft 12 and pivotal axis of the door A. As illustrated in FIG. 7, the follower surfaces in each pair of surfaces converge in a direction toward the other pair of surfaces and provide two generally U-shaped parabolic, i.e. tapered recesses at opposite lateral sides of the engagement portion.

Figure 8:
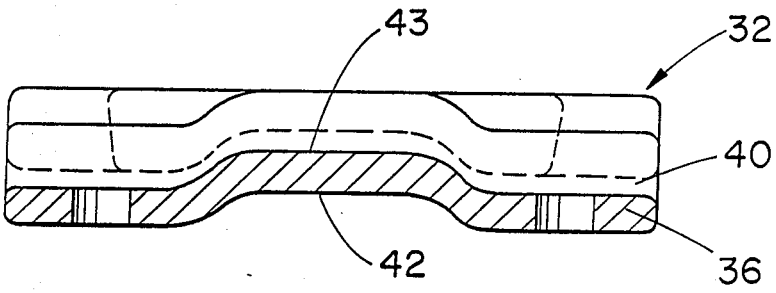
FIG. 8 is a cross-sectional view of the follower member taken along the line 8—8 of FIG. 7.

The follower member 32, further includes a stabilizing rib 41 centrally located and extending along the longitudinal axis of the follower member for increasing the strength and structural integrity of the follower member. As shown in FIG. 8, the rib 41 is integral with the follower member and raised from the plane of the mounting and transition portions along both the inner and outer surfaces of the member 32. As best seen in FIG. 7 the thickness of the follower is substantially increased where the engagement portion overlapping the door frame B and the rib member 41 are continuous along the edge of the follower 33 which engages the cam member 34. This increase in width serves to increase the strength and capability of the follower member for resisting racking and aligning the door A within the frame B during engagement of the cam member 34 and follower member 32.

The cam member 34 has a flat mounting portion 42, which is welded or otherwise secured to the door frame B at a location for cooperating engagement with the follower member 32. The mounting portion 42 of the cam member has an elongate rectangular configuration and a small vertical height dimension designated as "h." The small height dimension enables the door frame B or "header", to be similarly small in the vertical direction, without compromising the strength of the attachment or of the member itself.

Two wedges 46 extend outwardly from the mounting portion 44 of the cam member 34 and the door frame B, and each wedge includes two opposite engagement surfaces 48. As illustrated in FIGS. 6 and 7, the wedges 46 also include opposing initial engagement surfaces 50. The wedges 46 are preferably spaced from one another a distance enabling cooperating engagement with associated pairs of concave follower surfaces 39 on the follower member 32.

As illustrated in FIG. 5, engagement surfaces 48 are positioned opposite one another on each wedge 46 and converge in a direction toward the opposing wedge. The distance "H" the wedges project from the mounting portion 44 is generally determined by the location of the door control mechanism 10 of the present invention along the door frame B. Where, for example, the mechanism 10 is secured to the door A and door frame B at a location near the non-pivoted edge 13 of door A, the distance H of wedge 46 projection is increased. Conversely, as the mechanism 10 is attached to the door A and frame member B at a location closer to the pivoted edge 11 of the door A, the distance H of wedge 46 projection is decreased.

As illustrated in FIGS. 3 and 4 the follower and cam members 32, 34 are constructed and positioned to engage when the door A is moved to a closed position within the door frame B. When in the closed position, the wedges 46 of the cam member 34 are fully engaged with the follower member 32 along the follower surfaces 39. In this position, the follower surfaces of the follower member and the engagement surfaces of the cam member inhibit racking of the door within the frame resulting from operational stresses.

Figure 9:
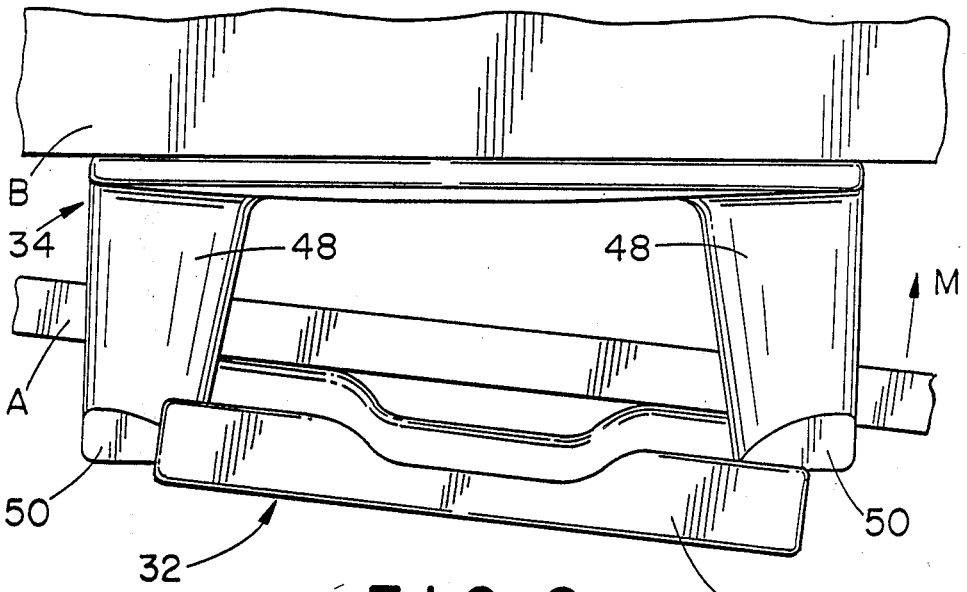
FIG. 9 is a top view showing partially engaged follower and cam members mounted on the door and associated door frame, respectively; and, FIG. 10 is a partial front elevational view of the follower and cam members of the present invention shown in the partially engaged position as in FIG. 9.
Figure 10:
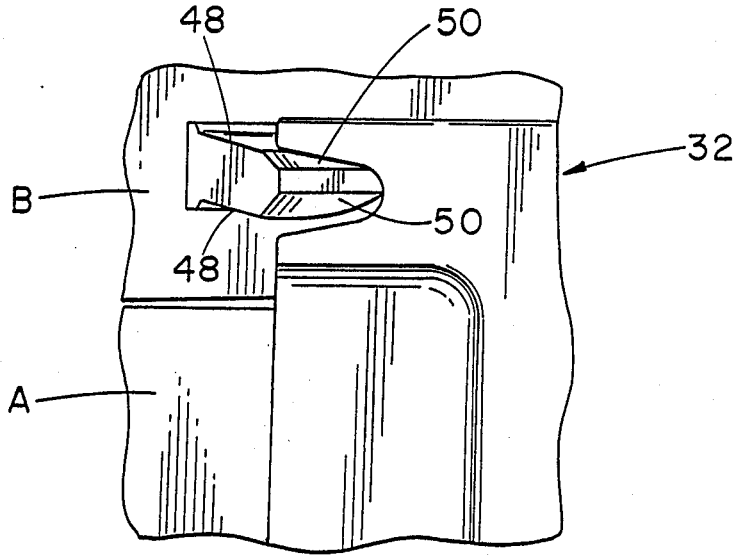

The manner in which the follower and keeper members engage when the door A is moved between the open and closed positions is illustrated in FIGS. 9 and 10. As the door is moved in the direction of the arrow M in FIG. 9, the follower and cam members are brought into relationship whereby the follower surfaces 39 of the follower member contact the engagement surfaces 50 and 48 of the cam member. The exact point of contact between the cam and follower members is dependent upon the alignment of the door A within the frame B. In some instances, the effect of external operational stresses may have racked the door frame B from its normally rectangular configuration to a skewed configuration, such as a rhombus. In this configuration the container corners are skewed such that the door A is out of alignment with the frame and is no longer capable of being easily moved to the closed position. When the door A is moved to the closed position in such situations, the wedge 46 of the cam member 34 positioned closest to the pivotal axis of the door A first engages the follower member. Depending on the direction in which the door frame is skewed, (whether to the right or left) the upper or lower engagement surface of the wedge will engage the upper or lower follower surface, respectively. Where the door frame is racked to a relatively extreme position, and the door therefore is significantly out of alignment, the initial engagement surfaces 50 of the wedge are the first to contact the follower surfaces of the follower member.

The engagement between the wedges and engagement surfaces brings the door and frame into alignment as the door is closed and thereafter assists anti-racking of the frame by resisting relative twisting between the cam and follower. Since the engagement relationship between the upper and lower mechanisms 10, 10' mounted on door A is reversed, if the top follower surface first engages the top initial engagement surface of the wedge of mechanism 10, the bottom follower surface correspondingly engages the bottom initial engagement surface of the cam member of mechanism 10'. Thus, both the upper and lower mechanisms 10, 10' force the misaligned door into alignment as the follower and cam members are engaged during movement of the door to the closed position.

During movement to the closed position, the wedge projections lead the follower member into complete engagement with the cam member. By guiding the follower member along engagement surfaces 48 of the cam members, the mechanism 10 begins aligning door A upon its first engagement with the members. Alignment continues until the door is properly aligned within the door frame B in the closed position. Once in the closed position, the inter engagement of the cam and follower member resist the racking of the frame.

While a preferred embodiment of this invention has been described in detail, it will be apparent that certain modifications or alterations can be made without departing from the spirit and scope of the invention set forth in the attached claims.

I claim:

1. In a cargo carrying structure having a rectangular door frame in an upright plane and a door pivoted at one edge to an upright side of the frame, and having an opposite edge spaced from and parallel to the pivoted edge, and further having a latching means for maintaining the door in a closed position adjacent the opposite edge, said frame being subject to racking in use, a follower on said door between the pivoted edge and the latching means, and a cam member on the frame engageable by the follower during and after closing of the door, and prior to latching, said follower comprising a mounting portion secured to a face of the door and opposed follower surfaces stationary relative to the door and extending beyond a top or bottom edge of the door in overlapping relationship with the frame when the door is closed for engaging the cam member, and said cam member having a mounting portion secured to the frame and a wedge extending from the mounting portion outwardly from the plane of the frame a distance sufficient to contact the follower surfaces when the door is partially closed, said wedge having two opposite and converging surfaces each tapering in two directions, one direction being outwardly from the mounting portion and the other direction being transversely of the outward direction, to be received between and cooperate with the opposed follower surfaces as the door is pivoted shut.

2. Apparatus for aligning a swinging door within an associated door frame, said apparatus comprising a shaft having a vertical axis of rotation, bearing members adjacent to opposite ends of said shaft for rotatably connecting said shaft to the swinging door with the shaft axis of rotation spaced from and parallel with the pivotal axis of the door, means attached to the shaft for oscillating said shaft about is longitudinal axis, means for latching said pivoted door in a closed position, including discrete latch members secured to said shaft adjacent opposite ends thereof, discrete keeper members adapted to be secured to structure adjacent opposite edge portions of the door and being engageable with said latch members, and non-latching alignment means discrete from any latching means, and intermediate said shaft and the pivot axis of the door for engagement and aligning of the door relative to the door frame as the door is swung to a closed position and maintained in the closed position upon operation of said latching means, said nonlatching alignment means including two cooperating elements, one non-movably fixed to the door and one non-movably fixed to the door frame structure.

3. The door control mechanism of claim 2 wherein said alignment means comprises a follower and a cam member for mutual engagement at a location spaced from said shaft and pivotal axis of the door along an edge of the door transverse to the shaft and pivotal axis to cooperate during movement of the swinging door to a closed position to align the door and frame.

4. The door control mechanism of claim 3 wherein said cam member includes a mounting portion having an elongate rectangular configuration and projections extending from the base in a direction outwardly of the frame and of the door when closed, spaced in a direction transverse to the pivot axis of the door, each of said spaced projections including follower engagement surfaces converging toward the opposite projection and having initial engagement surfaces additionally converging away from the mounting portion, said projections extending, for a distance sufficient to engage the follower while the door is partially closed and before the latching means is engaged.

5. The door control mechanism of claim 4 wherein the cam member is secured to the door frame and the follower is secured to the door.

6. A follower plate and cam member combination forming a non-latching door control mechanism discrete from any latching means, and used to align and restrain a pivoted door in an associated door frame, said plate having a planar mounting portion to be attached to an outside face of the pivoted door approximately midway across the width, and an engagement portion spaced from the mounting portion in a plane parallel with the mounting portion to extend beyond an edge of the door to overlap the associated door frame, said engagement portion including a cam-follower surface, tapered in a direction extending parallel to the plane of the base, and a transition portion interconnecting the mounting and engagement portions, said cam member having a mounting portion for attachment to said door frame and a post projecting from said mounting portion for a distance allowing engagement in use with said cam-follower surface when said pivoted door is partially closed and out of alignment with said frame, said cam member post having follower engagement surfaces converging toward one another in two transverse directions.

7. The follower plate of claim 6 wherein said cam-follower surface is parabolic.

8. In a cargo carrying structure having a rectangular upright door frame and a door pivoted about an axis at one edge to an upright side of the frame, said door having a distal edge opposite the one edge and a latching mechanism adjacent the distal edge, said frame being subject to racking in use, a follower on said door or frame and a cam member on the other of said door or frame intermediate the latching mechanism and the pivoted edge of the door engageable by the follower during and after closing of the door, the follower or cam member on the door being stationary relative to the door and extending beyond one edge of the door in overlapping relationship with the frame when the door is closed and the cam member and follower are engaged, said follower and cam member each including a mounting portion secured to the door or frame and mutually engaging surfaces, the surfaces of one of said follower and cam member being on first and second wedges spaced from one another in a direction transverse to the pivotal axis of the door and said surfaces extending from the mounting portion generally in the direction of the other cam member or follower for a distance sufficient to contact the other of said engaging surfaces to engage and cooperate with the opposed engaging surface to align the door and frame as the door is pivoted shut prior to latching, and said surfaces being tapered in two directions, on direction extending outwardly of the door and the other direction extending parallel with the door.

9. An apparatus for aligning a swinging door within an associated door frame, said apparatus comprising:

(a) a shaft having a vertical axis of rotation;

(b) bearing members adjacent to opposite ends of said shaft for rotatably connecting said shaft to a swinging door with the shaft axis of rotation spaced from and parallel with the pivotal axis of the door;

(c) means attached to the shaft for oscillating said shaft about its longitudinal axis, (d) means for latching said pivoted door in a closed position, including:

(i) discrete latch members secured to said shaft adjacent opposite ends thereof, (ii) discrete keeper members adapted to be secured to structure adjacent opposite edge portions of the door and being engageable with said latch members as the door is latched in a closed position;

(e) discrete non-latching alignment means secured to the swinging door and adjacent door frame structure intermediate said shaft and the pivot axis of the door, including a follower plate having a mounting portion to be attached to the door, and an engagement portion spaced from the mounting portion in a plane parallel with the door and mounting portion and extending beyond an edge of the door to overlap the associated door frame, said engagement surface including a cam-follower surface, tapered in a direction extending parallel to the plane of the door, and a cam member having a mounting portion and a post projecting from said mounting portion for nonlatching engagement with said cam followers surface, said post projecting a distance sufficient to engage the cam follower when said pivoted door is partially closed and out of alignment with said frame, said nonlatching engagement occurring prior to engagement of the latching means, said cam member post having follower engagement surfaces converging toward one another in two transverse directions.

* * * * *